United States Patent [19]

Caras

[11] 4,347,873

[45] Sep. 7, 1982

[54] FIXTURE FOR MAKING AN ASSEMBLY OF FINE WIRES

[75] Inventor: Bernard Caras, Princeton, N.J.

[73] Assignee: Burroughs Corporation, Detroit, Mich.

[21] Appl. No.: 166,059

[22] Filed: Jul. 7, 1980

[51] Int. Cl.[3] ..... H01J 9/14

[52] U.S. Cl. ..... 140/71.5; 29/25.16; 140/92.1

[58] Field of Search ..... 316/20; 140/92.1, 71.5; 84/285, 297; 29/25.14–25.17

[56] References Cited

U.S. PATENT DOCUMENTS

| | | | |
|---|---|---|---|
| 1,282,636 | 10/1918 | Schenvit | 84/285 |
| 2,683,833 | 7/1954 | Zaphiropoulos | 140/71.5 |
| 3,550,236 | 12/1970 | Lienert | 140/92.1 X |
| 3,574,927 | 4/1971 | Whetstone | 140/92.1 X |
| 3,776,613 | 12/1973 | Van Esdonk et al. | 313/220 X |

*Primary Examiner*—Kenneth J. Ramsey

*Attorney, Agent, or Firm*—Kevin R. Peterson; Robert A. Green; David G. Rasmussen

[57] ABSTRACT

The disclosure is of a fixture for forming an assembly of parallel wires comprising a frame formed to define an open central space, the frame carrying two sets of spaced-apart pins around which a wire is wound to form the desired individual parallel wires. The pins are slanted to insure proper seating of the individual wires on the frame, and, in each set, the pins are aligned on a slanted line to facilitate the winding operation. The frame also carries rectangular pins to which the winding wire can be easily secured at the beginning and end of a winding operation.

3 Claims, 4 Drawing Figures

FIXTURE FOR MAKING AN ASSEMBLY OF FINE WIRES

BACKGROUND OF THE INVENTION

SELF-SCAN panels, of the type shown in U.S. Pat. No. 3,989,981, include, among other electrodes, fine wire anodes disposed parallel and close to each other on the panel base plate to which they are secured. In one manufacturing method, a fixture known as a harp is used to form the wire assembly. The harp has two separate sets of closely spaced pins, and a fine wire is wound back and forth around the pins to form the desired number of parallel wires. This loaded fixture is placed on a support plate, which becomes the base plate for the final panel. The wound wires are cemented individually to the plate, and then they are cut to form the desired electrically individual wires.

The foregoing operation is generally satisfactory; however, problems exist. For one thing, the winding of wires on the adjacent closely-spaced pins of each set is not as easy as might be desired for an operator, and, in addition, sometimes the wires hang up on the pins and do not seat properly, and the later transfer to the base plate is defective. Thus, the time required to perform the winding operation is undesirably slow, and defective baseplate-wire assemblies occur.

The harp of the invention provides a faster winding time, greater yield, and its use can be learned more readily by operators.

DESCRIPTION OF THE INVENTION

Figure 1:
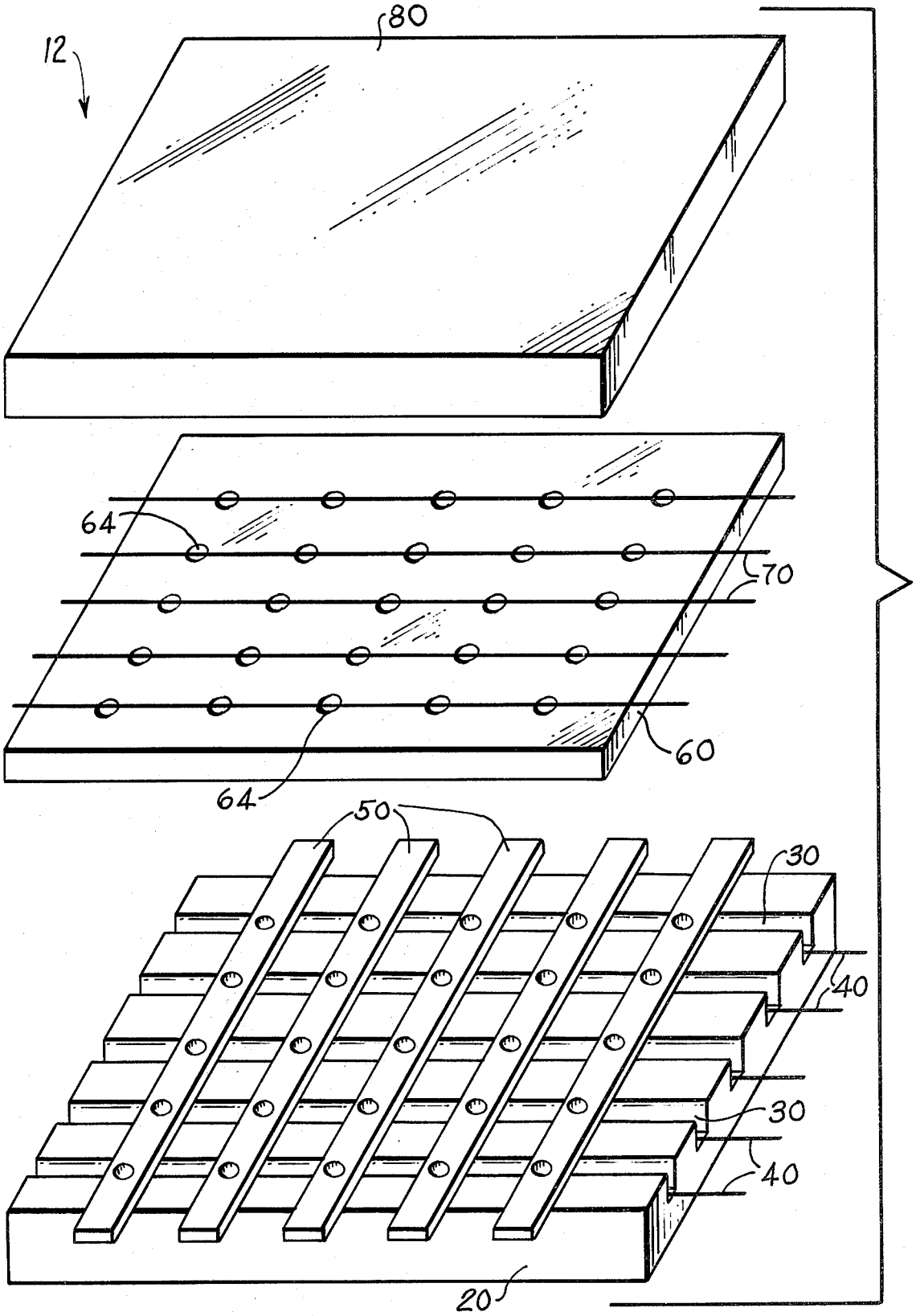
FIG. 1 is a perspective view of a display panel having electrodes prepared with the apparatus of the invention.
Figure 2:
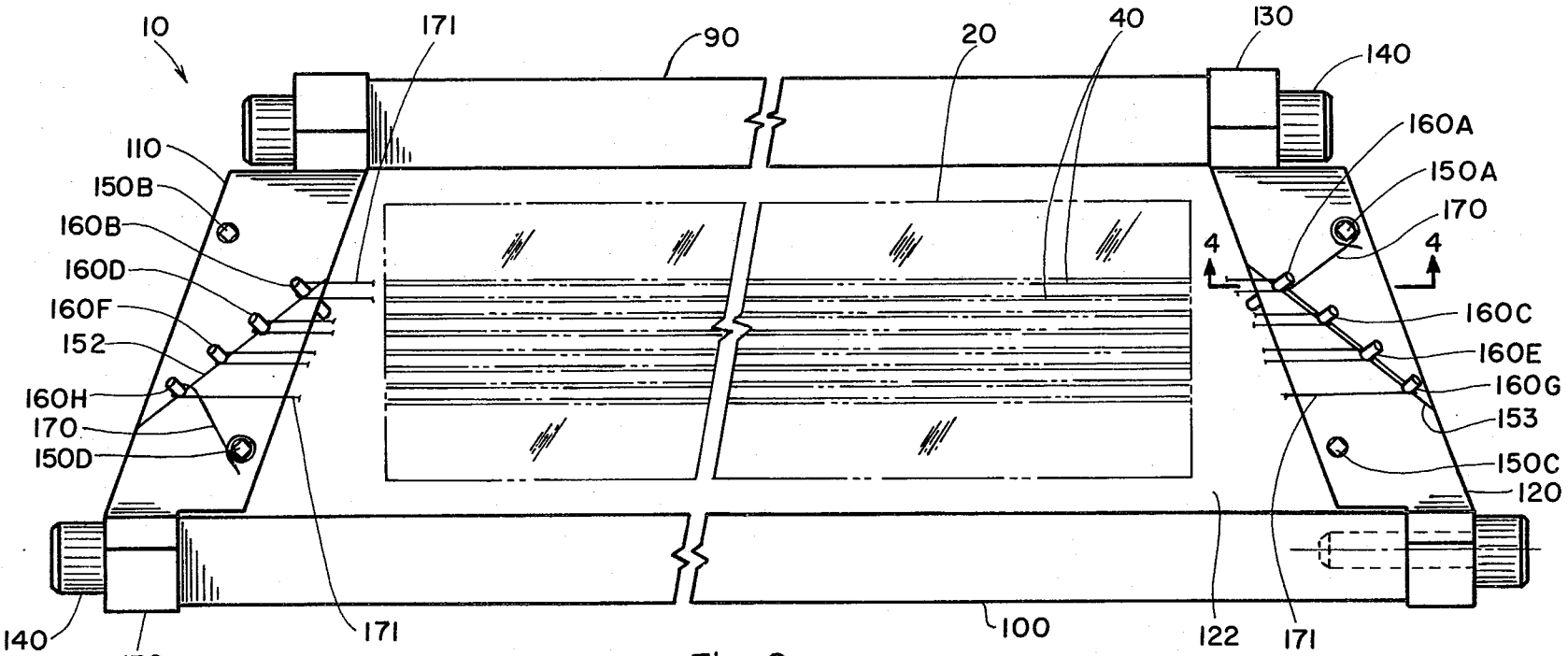
FIG. 2 is a plan view of the invention illustrating its operation.

The fixture of the invention 10 is known as a harp and is used in preparing assemblies of parallel wires for a SELF-SCAN panel 12 of the type shown in U.S. Pat. No. 3,989,981; issued Nov. 2, 1976, to Ogle et al for Panel-Type Display Device. Briefly, such a panel comprises a gas-filled envelope made up of a base plate 20 and a face plate 80 and various arrays of electrodes in between. The electrodes include an array of parallel scan anodes 40 in slots 30 in the base plate and an array of parallel apertured cathode strips 50 seated on the base plate and oriented transverse to the scan anodes to form rows and columns of scan cells. An apertured cell sheet 60 having apertures 64 is seated on the cathodes, and an array of parallel display anode wires 70 is disposed between the cell sheet and face plate and oriented parallel to the scan anodes. The cathodes and display anodes form rows and columns of display cells.

The harp 10 is used to make the assembly of base plate 20 and scan anodes 40, and face plate 80 and display anodes 70. The harp comprises upper and lower elongated metal bars 90 and 100 and left and right side metal bars 110 and 120. Preferably, the lower (or upper) bar 100 is longer than the upper (or lower) bar so that the side bars are not parallel, but are disposed at an angle to each other. The bars of the harp thus define a frame having an open central area, for a purpose to be described, across which the desired wires are strung, and the frame has a longitudinal axis which is parallel to the upper and lower bars 90 and 100.

Figure 3:
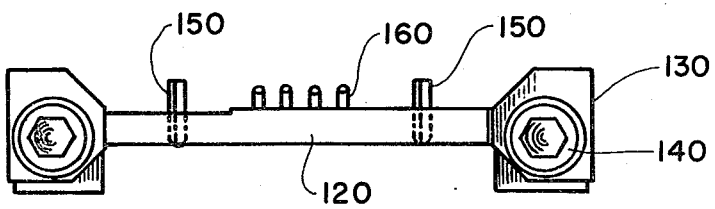
FIG. 3 is a side elevational view of the invention.
Figure 4:
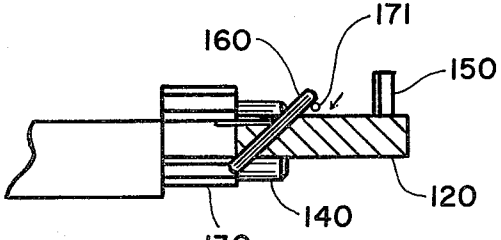
FIG. 4 is a sectional view along the lines 4—4 in FIG. 2.

Each side bar has an apertured boss 130 at its ends, through which a bolt 140 is inserted to engage the adjacent end of its associated elongated bar to hold all of the bars together. The bosses extend above the top surfaces of the bars and below the bottom surfaces of bars (FIG. 3) so that one harp can be rested on another without touching and distorting portions thereof, to be described.

Each side bar 110 and 120 has two spaced-apart vertical binding pins 150 extending a suitable distance above its surface, the pins having such a cross-section, e.g. triangular, square or rectangular, that they have one or more sharp edges. Each pair of pins is spaced apart near the ends of its bar, and the pins are used in securing a wire in place at the beginning or end of a wire winding operation, as described below. These pins also are tapered at their lower ends which are driven into holes in the side bars where they are held in place by the sharp edges engaging the wall of the hole. This allows both the holes and the pins to have loose tolerances with respect to each other.

Between each pair of pins 150, on each side bar, is an array of winding pins 160, each array being oriented on a line 152, 153, shown in dashes, which lies at an angle to the vertical or the longitudinal axis of the harp. The two lines 152 and 153 are slanted toward each other, generally following the slant of their side bars so that line 152 has a positive slope and line 153 has a negative slope. In addition, the pins 160 are disposed at an angle to the top surface of the bar on which it is mounted, and they slope away from the inner open space 122 defined by the upper and lower bars and the side bars.

In winding a wire on the harp 10, it appears to be preferred to begin the winding operation with the outermost of the pins 160. However, this is not essential, and the selected mode will depend on the operator. For purposes of description, the wire winding operation is begun at pin 150D, at the left, and the end of wire 170 is wound around this pin two or three times, with the sharp corners or edges of the pin causing the wire to grip the pin and hold to the pin without slipping. The wire is then wound one-half way around pin 160H across the frame, around pin 160G, back across the frame and around pin 160F, down to pin 160E, and then across to pin 160D, etc. This winding operation provides parallel wires 171 and is continued until the wire is wound around pin 160B, back around pin 160A to pin 150A, to which the wire is secured to complete the winding operation. The wire is wrapped a couple of times around pin 150A, and it is tugged. This tug cuts the wire across the last sharp edge it passes over and locks the wire to the pin.

The harp 10 carrying the wires which stretch across the frame is now placed over the slotted base plate 20 which is positioned in the open space defined by the upper and lower bars and left and right side bars of the harp, and the wires are seated in the slots 30 in the base plate and cemented in place therein. The other parts are then assembled with the base plate as required to complete the panel.

The harp 10 has many advantages. One advantage is that, at the beginning and end of a winding operation, the wire can be readily secured to the harp by being wound around one of the rectangular pins and tugged to lock it in place. Another advantage is that old wire ends which adhere to pins 150 can be removed merely by stripping the square pin upwardly with a tweezer, and the wire stubs fall off. Another advantage lies in the slanted arrangement of the winding pins which insures that, as the wire 170 is wound, the individual wires 171 slip downwardly to the bases of the pins 160 as required.

It is noted that the elongated metal bars 90 and 100 are preferably made of a material which has a larger coefficient of thermal expansion than the wires 171 carried thereby so that, when the assembly is heated to cure the cement which holds the wires to the base plate, the larger thermal expansion stretches the wire beyond their elastic limit, and this stretching straightens the wires so that they are straight and taut in the final assembly. After the assembly cools, the wire ends are slack and can be easily removed from the harp.

Also, the side bars 110 and 120 are made of material that has the same coefficient of thermal expansion as the wire 170 and glass base plate so that, when the assembly is heated, the pitch of the wires is unchanged. The top surfaces of the side bars should be flat and coplanar so that the wires 171 all lie in the same plane after they are wound.

It is noted that the pins 160 and 150 should be accessible from the rear surface of the fixture so that they can be readily removed and replaced, if necessary.

Although the slant of the side bars 110 and 120 is not required, it permits alignment of the pins 160 on a slanted line with narrower side bars, to effect a saving in material.

With the pin arrangements described, the harp can be wound either from left to right or right to left to accomodate lefthanded or righthanded operators.

What is claimed is:

1. A fixture for forming an assembly of wires on a support plate comprising a frame having a longitudinal axis including upper and lower bars and left and right side bars, all of the bars being secured together and defining an open space between them, first and second groups of pins on said side bars and spaced from each other so that a wire can be wound around said pins and between the pins of each group to form the desired individual wires oriented generally parallel to said axis, the pins of each group being disposed on a line oriented at an angle to said longitudinal axis, and a plurality of binding pins on said frame to which the ends of a winding wire can be secured, said binding pins having such a cross-section that the binding pins have a sharp edge which secures the wire in place when it is tightly wound around the pin.

2. The fixture of claim 1 wherein each of said pins is disposed at an angle to the surface of the bar on which it is mounted so that it slants away from said open space and so that a wire wound around a pin tends to slide down along the pin to rest on the surface of the bar as required.

3. The fixture of claim 2 wherein each of said side bars is disposed at an angle to said axis, the angle of the side bar being similar to the angle of the line of its pins.

* * * * *